US006573443B1

(12) United States Patent
Chen

(10) Patent No.: US 6,573,443 B1
(45) Date of Patent: Jun. 3, 2003

(54) PEDAL STRUCTURE FOR MUSICAL DRUM

(76) Inventor: Ming-Hwai Chen, PO Box 82-144, Taipei (TW)

( * ) Notice: Subject to any disclaimer, the term of this patent is extended or adjusted under 35 U.S.C. 154(b) by 0 days.

(21) Appl. No.: 10/067,353

(22) Filed: Feb. 7, 2002

(51) Int. Cl.[7] ..... G10D 13/02
(52) U.S. Cl. ..... 84/422.1
(58) Field of Search ..... 84/422.1, 422.2, 84/422.3

(56) References Cited

U.S. PATENT DOCUMENTS 1,042,919 A * 10/1912 Hughes ..... 84/422.2
4,134,325 A * 1/1979 Loftus ..... 84/422.1
4,691,613 A * 9/1987 Jacobson ..... 84/422.1
6,150,596 A * 11/2000 Hsieh ..... 84/422.1

* cited by examiner

*Primary Examiner*—Shih-Yung Hsieh
(74) *Attorney, Agent, or Firm*—Leong C. Lei

(57) ABSTRACT

The present invention relates to a pedal structure having a pedal of which the pedal sloping angle and the tension of the pedal can be adjusted. The pedal structure comprises a front seat board, a rear seat board and the pedal, wherein the rear seat board and the front seat board are stacked and fastened to each other at one end. A plurality of holes arranged in row is provided at one end of the rear seat board and the sloping of the pedal is adjusted by adjusting the total length of the front seat board and the rear seat board.

4 Claims, 3 Drawing Sheets

PEDAL STRUCTURE FOR MUSICAL DRUM

BACKGROUND OF THE INVENTION (a) Technical Field of the Invention

The present invention relates to pedal structure for musical drum, in particular, to a pedal structure including a front seat board connected to a rear seat board having a plurality of holes so that the connection of the front seat board with the rear seat board can be adjusted so as to provide a sloping to the pedal of the musical drum.

(b) Description of the Prior Art

A conventional pedal structure for musical drum is shown in FIGS. 4 to 6. The pedal structure includes a pedal frame 30 having a beater 31 at the top section thereof and a pedal 32, and a chain connecting the beater 31 to the pedal 32 to form the pedal structure for the musical drum. Generally, the bottom face of the pedal frame 30 is provided with a frame shaft or a seat board 34 to position the pedal structure. One end of the seat board 34 for positioning is directly locked to the bottom section of the pedal frame 30, and the end of the surface of the seat board 34 has a screw hole 36 to mount the end terminal of the pedal 32. The other end of the pedal 32 is connected to the chain 33 so that the pedal 32 is formed into a sloping structure, facilitating the drummer to step onto the pedal to beat the drum.

As the seat board 34 has a single board face and the seat board 34 has to be placed horizontally on the floor at a higher level, the pedal 32 connected to the seat board 34 together with the chain 33 will produce a gap and therefore the swinging angle of the pedal 32 cannot be adjusted. As a result, the exertion of force by stepping at the pedal 32 is uncomfortable to the user. Further, the mounting of pedal frame to the seat board by means of a conventional screw bolt 35 is not conveniently unscrewed or tightened after a period of use. Accordingly, it is an object of the present invention to provide a pedal structure for musical drum which mitigates the above drawbacks.

SUMMARY OF THE INVENTION

Accordingly, it is an object of the present invention to provide a pedal structure for musical drum, wherein the front seat board and the rear seat board are stacked and locked to each other, wherein one end of the front seat board and the bottom face of the pedal frame are fastened to each other, and the other end of the front seat board is provided with at least one protruded ridge and a positioning hole for the mounting with at least one protruded ridge and a through hole provided on the rear seat board, the front seat board and the rear seat board are stacked and screw nuts and screw bolts are used to fasten the seat boards, thereby the end terminal of the rear seat board and the end section of the pedal are mounted to form the pedal structure of which the sloping of the pedal can be adjusted.

Yet another object of the present invention is to provide a provide a pedal structure for musical drum, wherein one or more than one parallel protruded ridges are provided on the board surface of the front and rear seat board, enhancing the positioning of the rear seat board on front seat board. A further object of the present invention is to provide a pedal structure for musical drum, wherein the center through holes on the stacking portion of the rear seat board are arranged in a row.

Yet another object of the present invention is to provide a pedal structure for musical drum, wherein the sloping of the pedal is adjustable to provide a comfortable position to the drummer.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 3:
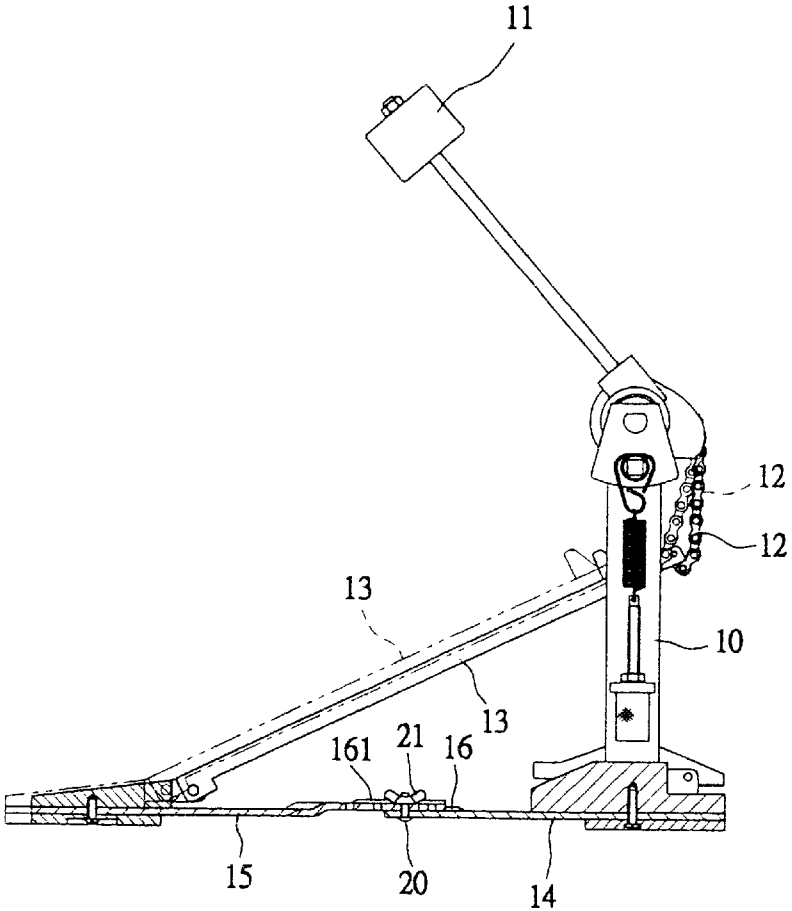
FIG. 3 is a section view of a pedal structure for musical drum in accordance with the present invention.
Figure 1:
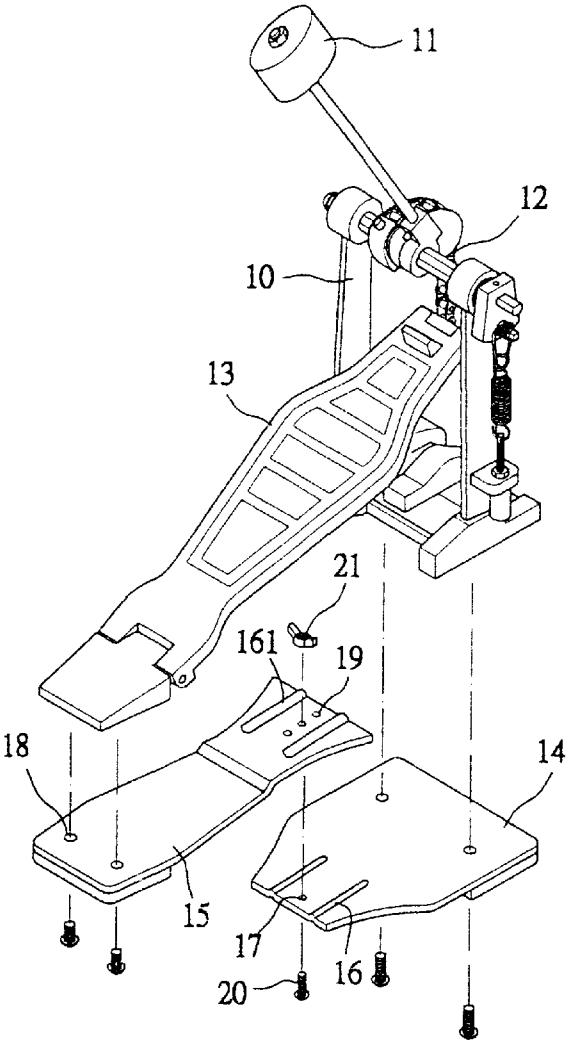
FIG. 1 is a perspective exploded view of a pedal structure for musical drum in accordance with the present invention.
Figure 2:
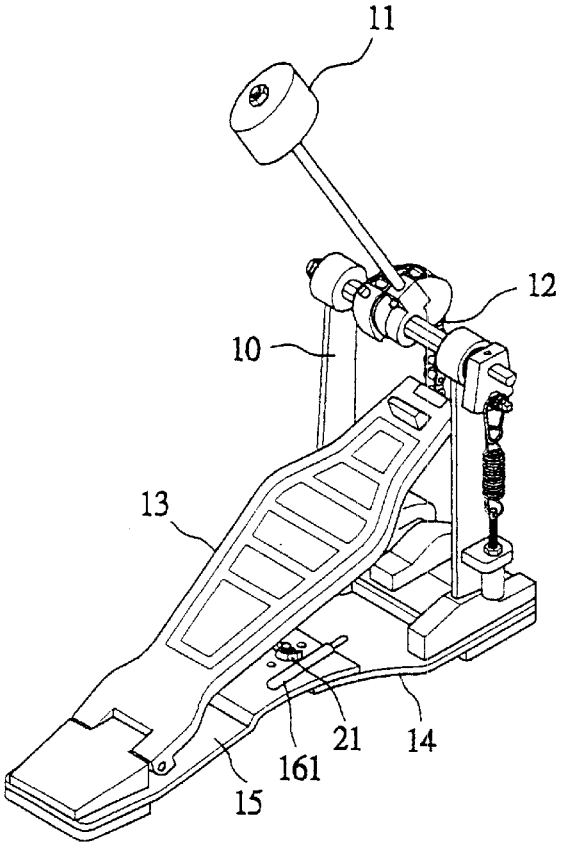
FIG. 2 is a perspective view of a pedal structure for musical drum in accordance with the present invention.
Figure 5:
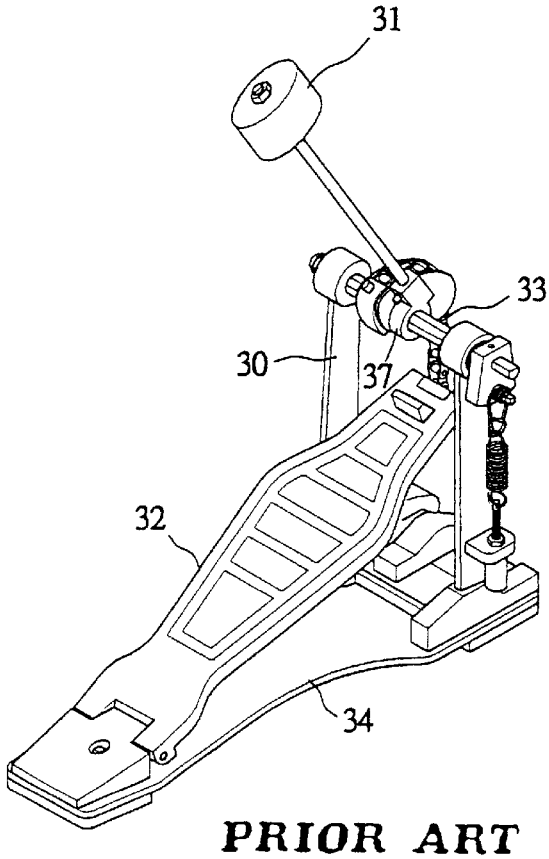
PRIOR ART FIG. 5
FIG. 5 is a perspective view of the conventional pedal structure for musical drum.
Figure 6:
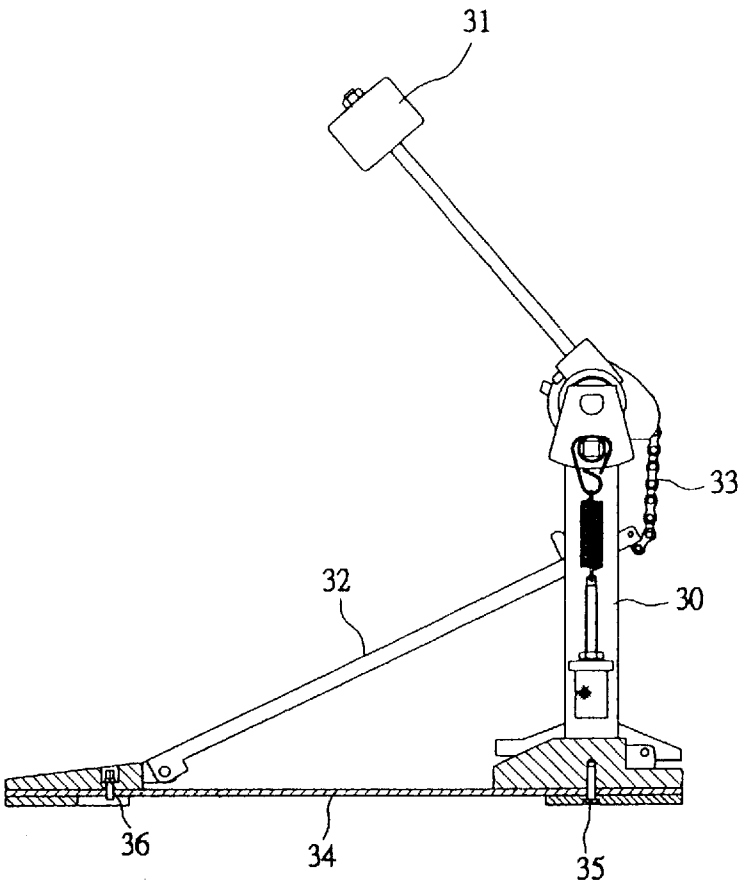
PRIOR ART FIG. 6
FIG. 6 is a sectional view of the conventional pedal structure for musical drum.
Figure 4:
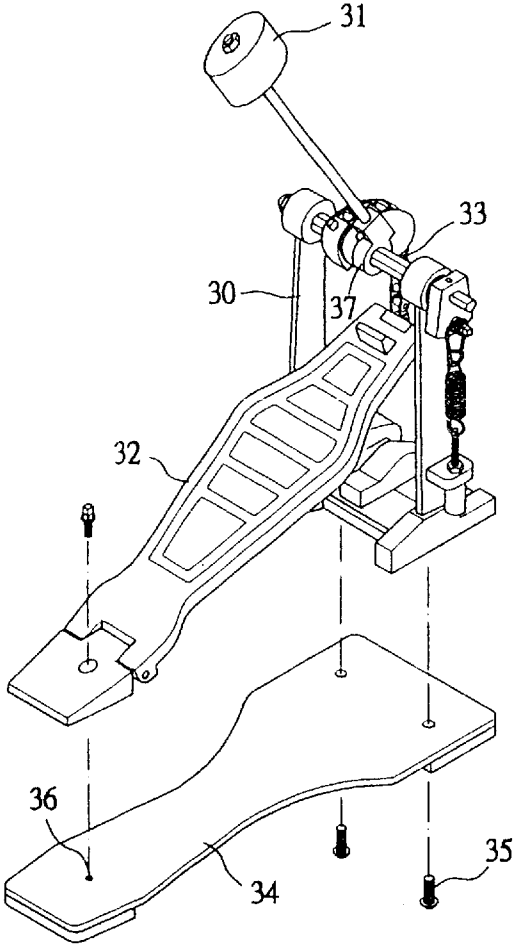
PRIOR ART FIG. 4
FIG. 4 is a perspective exploded view of a conventional pedal structure for musical drum.

Referring to FIGS. 1 to 3, there is shown a pedal structure for musical drum comprising a pedal frame 10, a beater 11 mounted at the top portion of the pedal frame 10, and a chain 12 connected to a pedal 13. In accordance with the present invention, a front seat board 14 and a rear seat board 15 are stacked and locked to each other at the end section thereof and are located at the bottom section of the pedal frame 10. One end of the front seat board 14 is directly locked at the bottom end of the pedal frame 10 to form one body, and the other end of the front seat board 14 is provided with at least one parallel arranged protruded ridges 16, and at the center of the end of the front seat board 14, a positioning hole 17 is provided. On the other hand, one end of the rear seat board 15 is provided with a plurality of seat holes 18 for the mounting with the end of the pedal 13. At the other end of the rear seat board 15 for connection, at least one protruded ridges 161 similar in structure to that of the protruded ridges 16 on the front seat board 14. The formation of the protruded ridges 16 is by upward punching process from the bottom face of the seat board 14, 15 to form a recess so that the ridges 16, 161 can be stacked to each other.

On the surface of the rear seat board 15, corresponding to the shaft having the positioning hole 17, plurality of spaced apart through holes 19 are provided for adjustably locking of the front and rear seat boards 14, 15 by means of screw bolt 20 and screw nut 21. In accordance with the present invention, the adjustment of the locking position of the pedal 13 can be achieved easily and conveniently.

In accordance with the present invention, the structure provides a convenient way of installation. First, the stacking of the front and rear seat boards 14, 15 has reduced the surface of the boards 14, 15, and this facilitates packaging and shipping. Secondly, as the pedal 13 and the rear seat board 15 are normally locked to each other, if adjustment is to be made, the screw nut 21 and the screw bolt 20 are loosened and the length of the entire seat boards 14, 15 can be either retracted or extended without unloading or removing of the pedal 13. As a result, the entire pedal 13 structure is stable and the entire locked seat boards 14, 15 provide a strong structure as the protruded ridges 16, 161 are stacked with each other and the screw nut 21 and screw bolt 20 are locked to the seat boards 14, 15. The screw nut 21 for locking has the shape with a turning wing for manually operation. As a result, the fastening and unfastening of the screw nut 21 can be conveniently and easily achieved without using any tools. The pedal structure of the present invention can also be suitably used in all sorts of pedals for musical drums.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A pedal structure for musical drum including a pedal frame, a beater and a chain connected a pedal, and a front and a rear seat board, characterized in that the front seat board and the rear seat board are stacked and locked to each other, wherein one end of the front seat board and the bottom face of the pedal frame are fastened to each other, and the other end of the front seat board is provided with at least one protruded ridge and a positioning hole for the mounting with at least one protruded ridge and a through hole provided on the rear seat board, the front seat board and the rear seat board are stacked and screw nuts and screw bolts are used to fasten the seat boards, thereby the end terminal of the rear seat board and the end section of the pedal are mounted to form the pedal structure of which the sloping of the pedal can be adjusted.

2. The pedal structure of claim 1, wherein one or more than one parallel protruded ridges are provided on the board surface of the front and rear seat board, enhancing the positioning of the rear seat board on front seat board.

3. The pedal structure of claim 1, wherein the center through holes on the stacking portion of the rear seat board are arranged in a row.

4. The pedal structure of claim 1, wherein the screw nut for fastening the rear seat board with the front seat board is provided with a turning wing, facilitating the fastening of the screw nut manually.

* * * * *